US008297874B2

(12) United States Patent
Krzyzak

(10) Patent No.: US 8,297,874 B2
(45) Date of Patent: Oct. 30, 2012

(54) TRAFFIC BEARING STRUCTURE WITH PERMEABLE PAVEMENT

(75) Inventor: Gerald Krzyzak, Niles, IL (US)

(73) Assignee: Vulcan Materials Company, Birmingham, AL (US)

( * ) Notice: Subject to any disclaimer, the term of this patent is extended or adjusted under 35 U.S.C. 154(b) by 322 days.

(21) Appl. No.: 12/713,306

(22) Filed: Feb. 26, 2010

(65) Prior Publication Data

US 2011/0211908 A1 Sep. 1, 2011

(51) Int. Cl.
*E01C 3/00* (2006.01)

(52) U.S. Cl. ..... 404/31; 404/82

(58) Field of Classification Search ..... 404/27, 404/31, 72, 75, 82
See application file for complete search history.

(56) References Cited

U.S. PATENT DOCUMENTS

| | | | | |
|---|---|---|---|---|
| 912,898 | A | 2/1909 | Schutte | |
| 1,064,408 | A | 6/1913 | Webster | |
| 1,115,259 | A | 10/1914 | Wallace | |
| 1,269,785 | A | 6/1918 | Chatfield | |
| 1,569,702 | A | 1/1926 | Brown et al. | |
| 1,717,445 | A | 6/1929 | Flood | |
| 3,076,717 | A * | 2/1963 | Minnick | 106/710 |
| 5,320,447 | A | 6/1994 | Ubero | |
| 5,697,730 | A | 12/1997 | Goering | |
| 5,849,069 | A * | 12/1998 | Grabosky et al. | 106/217.9 |
| 5,961,389 | A | 10/1999 | Dickinson | |
| 7,168,884 | B2 | 1/2007 | Hart | |
| 8,025,456 | B2 * | 9/2011 | Kaul | 404/27 |
| 8,137,024 | B2 * | 3/2012 | Kaul | 404/31 |
| 8,142,101 | B2 * | 3/2012 | Kaul | 404/31 |
| 2008/0050516 | A1 | 2/2008 | Dickinson | |
| 2008/0292865 | A1 | 11/2008 | Ball et al. | |

* cited by examiner

*Primary Examiner* — Gary S Hartmann
(74) *Attorney, Agent, or Firm* — Mark Swanson; Bradley Arant Boult Cummings

(57) ABSTRACT

A traffic bearing structure with a permeable pavement includes a subgrade, a base positioned on top of the subgrade, and a wear surface positioned on top of the base. The base includes aggregate compacted in a single lift, where the aggregate in the base includes different sized particles mixed together. The wear surface includes a permeable pavement. The particle size distribution of the aggregate in the base is selected to provide adequate stability and permeability for the permeable pavement.

16 Claims, 4 Drawing Sheets

TRAFFIC BEARING STRUCTURE WITH PERMEABLE PAVEMENT

BACKGROUND OF THE INVENTION a: Field of the Invention

This invention relates to traffic bearing structures such as roads and parking lots. In particular, this invention relates to traffic bearing structures having a permeable pavement for the wear surface.

b: Description of the Related Art

Traffic bearing structures have been used by man for many years. Some examples of traffic bearing structures include roads on which we drive and parking lots where we park. There are many different types of surfaces which can be used with a traffic bearing structure, and these top surfaces are often referred to as a "wearing surface" or a "wear surface." Some examples include asphalt, concrete, block pavers, gravel, grass, and dirt. Harder wearing surfaces can support larger loads, reduce dust and dirt, and provide a smoother surface. Examples of harder wearing surfaces include asphalt, concrete, and block pavers, all of which can be referred to as pavement. Many users prefer harder wear surfaces, and are willing to pay more for them.

Historically, harder wear surfaces tend to be water-resistant or waterproof so that rainfall simply runs off, and does not soak in to any appreciable extent. When large areas are paved over with non-permeable wear surfaces, water from rainfall tends to collect quickly and large surges of water are seen in the stormwater systems adjacent to paved surfaces. Large surges of storm water can increase the chance of flash floods, and can carry trash, solids, pollutants, and debris to local waterways. In some locations, storm water is directed to waste water treatment plants, and storm water surges can overload the waste water treatment facility. The rapid run-off of rainfall from non-permeable paved surfaces is generally considered undesirable.

Certain regulations encourage the use of permeable pavements, where permeable pavements are pavements which allow water to permeate through the pavement. Some storm water regulations can require the use of holding ponds or filtration areas for new construction projects involving non-permeable surfaces which cover a significant portion of the land. For example, if a new shopping center were to be installed and several acres of land were to be paved to provide parking, regulations may require a holding pond to collect and hold storm water runoff and thereby reduce the peak load of stormwater exiting the new shopping center. By providing a permeable pavement on the parking area, water that strikes and collects on the parking area tends to soak through the pavement and into the ground underneath. The base then serves to hold the water and allow it to slowly percolate into the earth underneath the base. This use of permeable pavement can reduce or eliminate the need for holding ponds which are regulatory required. By reducing or eliminating the need for holding ponds, more real estate is available to be developed. This can allow for more retail space and more parking, and provides a higher end use for the real estate. This allows more productive use of the land while still reducing the peak flows from stormwater.

A permeable pavement used in a traffic bearing structure, such as a parking lot, has to be able to handle the traffic load without being damaged. The permeable pavement has to be strong enough to support the cars, trucks and other vehicles traveling on the parking lot. Much of the strength of a permeable pavement comes from the base underneath it, and so a stronger, more stable base can increase the traffic load a permeable pavement can support. Roads tend to have heavier vehicles and higher traffic flow than parking lots, and often require higher load ratings. Providing a base which is strong enough to support the permeable pavement and yet capable of allowing water to flow through it can facilitate the use of permeable pavements in services which require higher load ratings. In many cases, permeable pavements have been used for driveways, certain parking lots, and other uses with limited load ratings.

The base underneath a permeable pavement is often an aggregate. Certain types of aggregate are known and available. One such aggregate is referred to as a dense graded base. Another type of aggregate available is an open graded base. The dense graded base tends to be very stable, but has relatively low permeability, whereas the open graded base tends to have higher permeability but less stability. The base used beneath many permeable pavements includes at least two different types of aggregate, where each type is independently compacted. Different types of aggregate can be differentiated by the size distribution of the particles within each type of aggregate. Providing a base which is permeable, strong, and stable for use with permeable pavements is desirable.

BRIEF SUMMARY OF THE INVENTION

A traffic bearing structure includes a subgrade, a base positioned on top of the subgrade, and a wear surface positioned on top of the base. The base includes aggregate compacted in a single lift, where the aggregate in the base includes different sized particles mixed together. The particle size distribution of the aggregate in the base is selected to provide adequate stability and permeability for the traffic bearing structure. The wear surface includes a permeable pavement.

DETAILED DESCRIPTION OF THE INVENTION

Certain pavements have been developed which are permeable. The term "pavement" as used in this description refers to a surface designed and intended for vehicular traffic, and does not include surfaces designed and intended for only pedestrian traffic, such as surfaces for athletic competition. These permeable pavements include porous concrete, porous asphalt, block pavers, and turf pavers. Water can pass through these permeable pavements and enter the base underneath. This slows the runoff of water and reduces the load on the adjacent stormwater systems. This can reduce peak loads on wastewater facilities when stormwater is directed to these wastewater facilities, and it can also help to improve the quality of local waters by reducing the influx of trash, solids, pollutants, and debris. When water passes through a permeable pavement and then infiltrates into the ground, the ground serves as a filter and tends to clean the water.

In order to reduce the amount of runoff from a permeable pavement, it is desired that the pavement not have too steep of an angle. This allows the water to remain on the pavement for a longer period and provides more time for the water to soak through the permeable pavement and into the base underneath. Typically, permeable pavement manufacturers recommend that the angle on a permeable pavement not exceed five degrees, although other angles are possible, and the permeable pavement will function as a traffic bearing surface even if this angle is exceeded. Also, many permeable pavement manufacturers recommend that the traffic bearing structure be installed such that soil, dirt and trash from neighboring areas do not wash onto the permeable pavement. This soil and dirt can infiltrate into the permeable pavement such that water flow through the pavement is slowed or even stopped. Permeable pavements typically have interconnected pores which allow water to work its way through the permeable pavement and be pulled down into the base by gravity. Dirt or other solids can clog some of these interconnected pores and slow or block the flow of water through the permeable pavement.

Traffic Bearing Structures

Figure 1:
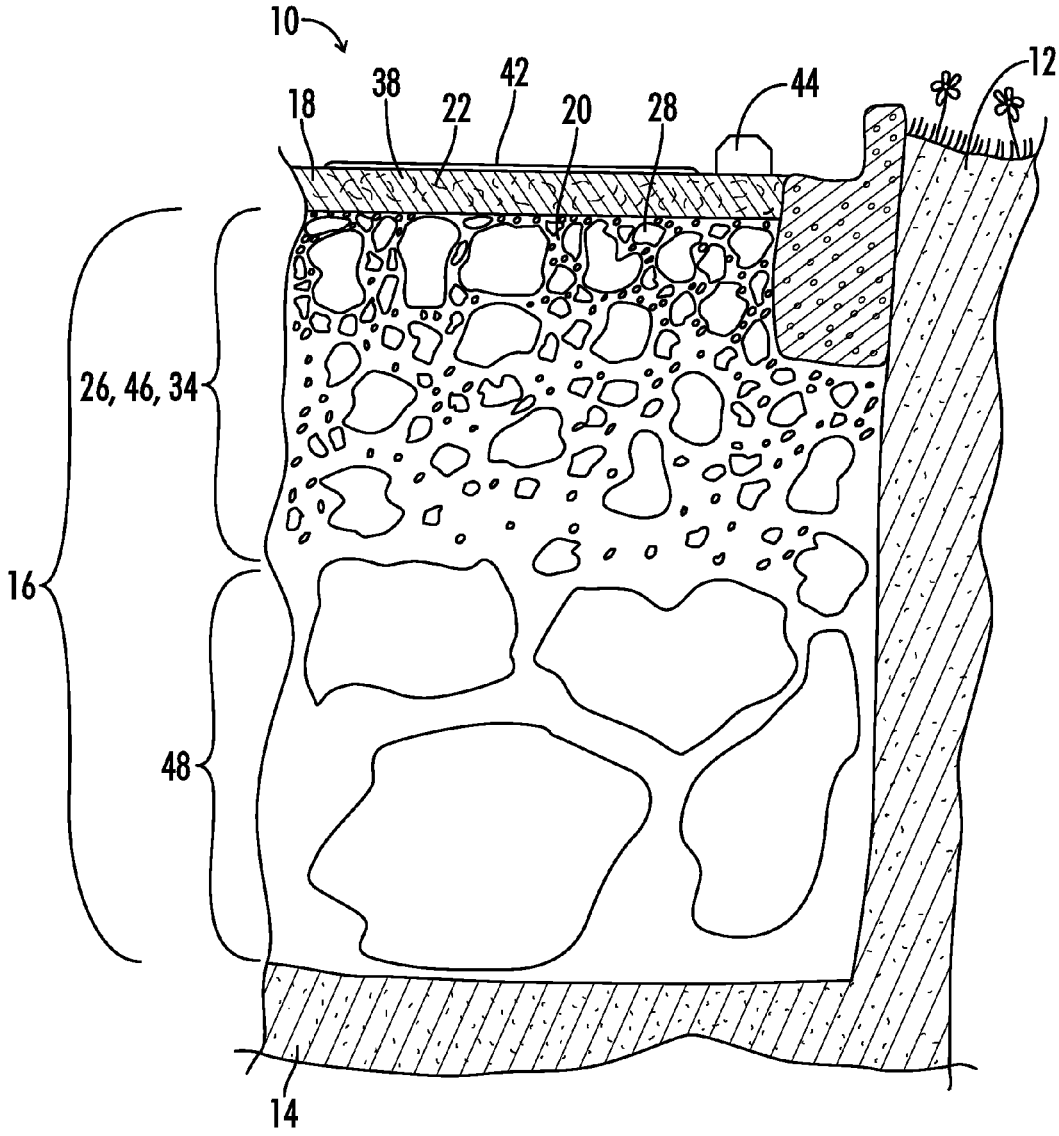
FIG. 1 is a cross sectional side view of one embodiment of a traffic bearing structure where the wear surface includes porous asphalt.

Traffic bearing structures for supporting vehicles are familiar in the United States. A traffic bearing structure 10 is often placed on a land surface such that one can walk from the traffic bearing structure 10 directly onto the adjacent land 12, as seen in FIG. 1. The land 12 can be a wide variety of different things, including the lawn in front of a house, the fields on the side of the road, and a ditch next to a parkway. The land 12 can be sand, dirt, clay, rocks, or a wide variety of other things. The land 12 includes basically anything adjacent to a road, parking lot, or other traffic bearing structure 10. "Traffic bearing structures" are defined to include structures designed and built to support vehicles having wheels, so traffic bearing structures 10 can include roads, parking lots, bridges, tunnels, and other structures which are designed for bearing vehicular traffic.

A traffic bearing structure 10 generally has at least three primary components. This includes the subgrade 14, the base 16 and the wear surface 18. The subgrade 14 can be basically the land 12, which has been graded and prepared for use as a subgrade 14, but the subgrade 14 can also be added material which provides a lower foundation for the traffic bearing structure 10. This added material for the subgrade 14 can be aggregate, or it can be clay, dirt, or a wide variety of other materials which are placed on the ground to provide a foundation for the traffic bearing structure 10.

The base 16 is typically comprised of aggregate 20, where "aggregate" is defined to include a collection of particles 28. The aggregate 20 is generally compacted in what is referred to as a lift 26. Typically, the aggregate 20 is laid down in a layer as a loose fill, leveled and smoothed, and then compacted. A lift 26 is produced when a single layer of aggregate 20 is compacted. Sometimes, different grades of aggregate 20 will be combined in the base 16, and these are typically compacted separately. So on occasion, adjacent lifts 26 will have a distinction between one size aggregate 20 and another size aggregate 20, as seen in the two separate lifts 26 in FIG. 1. Reference to the size of an aggregate 20 refers to the distribution of the size of the particles 28 which make up the aggregate 20. However, in other embodiments, the same aggregate 20 material will be combined and compacted in more than one layer and more than one lift 26 as the roadway or the traffic bearing structure 10 is built. In this description, a lift 26 is referred to as each time the loose material is added and compacted, regardless of whether the aggregate 20 is the same size or different than the previous layer.

The current invention includes a wear surface 18 which is a permeable pavement 22. This means the permeable pavement 22 allows water to flow through at a sufficient rate to minimize the runoff of water into adjacent stormwater handling systems. As a general rule of thumb in this description, a pavement is considered permeable if it has a permeability rate for water at least equal to 10 feet per day.

Figure 2:
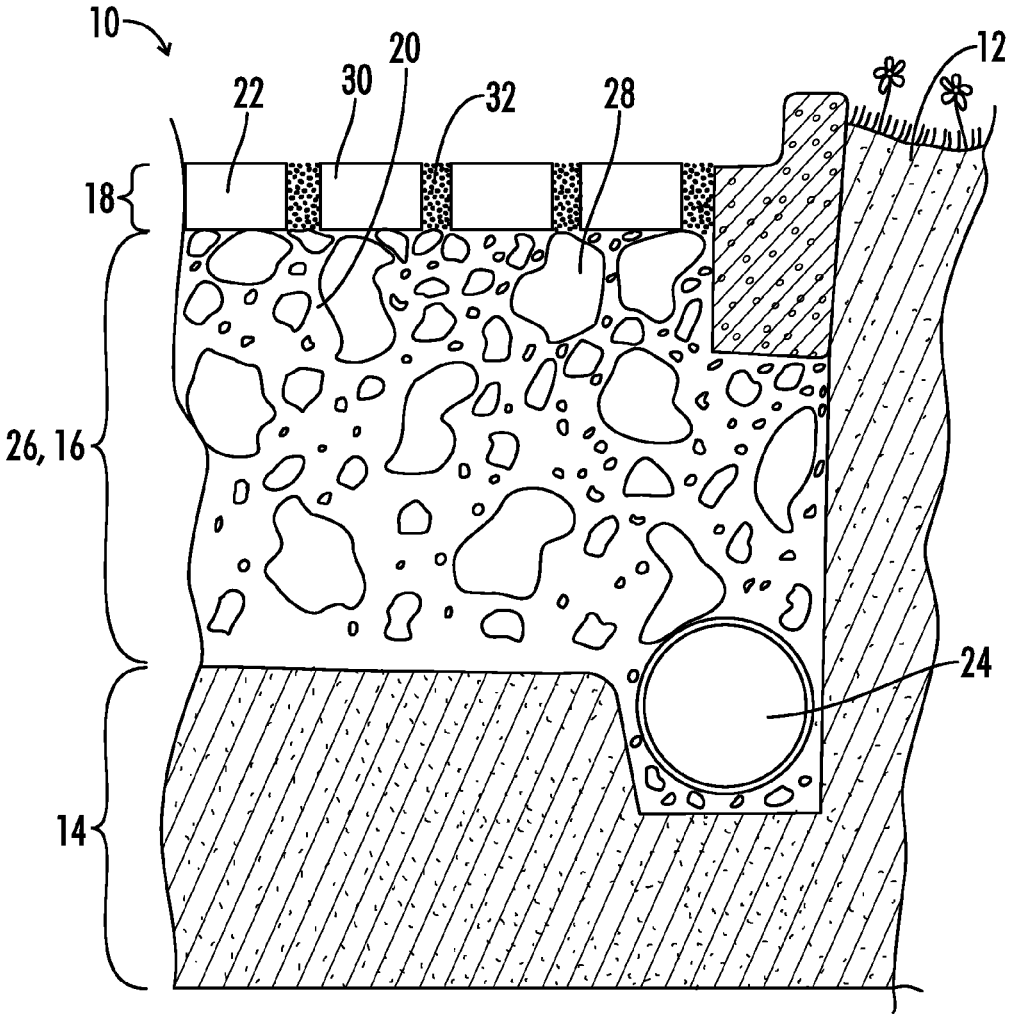
FIG. 2 is a cross sectional side view of an alternate embodiment of a traffic bearing structure including a drain line, where the wear surface includes block pavers.

When it rains or when water is applied to a permeable pavement 22, the water can go into a drainage system which results in a more gradual release of the water. Different drainage options are available for different traffic bearing structures 10 using permeable pavements 22. In one embodiment, the water slowly percolates into the subgrade 14, and exits from underneath the traffic bearing structure 10. In another embodiment shown in FIG. 2, a drain line 24 can be included in the base 16 and/or subgrade 14 such that water is able to collect in the drain line 24 and flow out of the traffic bearing structure 10 through the drain line 24. Using a single lift 26 over a drain line 24 can increase the depth of material between the compactor and the drain line 24, and thereby reduce damage to the drain line 24 during compaction.

In yet another embodiment, one or more weirs can be included in and/or adjacent the traffic bearing structure 10 such that water will overflow from the weirs and be gradually released to the environment. A weir can be used to supplement other drainage techniques such as drainage into the subgrade 14, or drainage with the drain line 24. The use of a drain line 24, a weir, drainage into the subgrade 14, or any other water draining device or technique can be used in isolation or in combination, as desired.

The base 16 underneath the permeable pavement 22 generally serves as a storage area for water. The storage capacity of the base 16 must be large enough to hold the collected water and allow this water to be gradually released into the environment, such as by absorbing into the subgrade 14. The water storage capacity of the base 16 must take into consideration the rate at which water leaves the base, such as the absorption rate of the subgrade 14, the drain rate of any drain lines 24 or weirs, or any other mechanism used for allowing the water to exit from the base 16. The water holding capacity of the base 16 also must consider the application rate of the water. For example, certain areas will receive more water than other areas, and rain will fall more rapidly in some areas. The rate at which water permeates into the base and the rate at which water exits the base must be considered in the design of traffic bearing structures 10. A traffic bearing structure 10 in an area which tends to receive several inches of rain within an hour will typically need a base 16 which is able to hold more water than a traffic bearing structure 10 in an area which seldom receives more than half an inch of rain at a time. The required water storage volume can be determined during the permeable pavement 22 design. Required thickness of the base 16 can be determined, in part, by using the anticipated percent voids in the base 16 at a specified density.

The water holding capacity of the lift 26 underneath the permeable pavement 22 is generally determined by the depth of the lift 26 and also the porosity of the lift 26. A more porous lift 26 has more open space and is able to hold more water, and a deeper lift 26 has more room for the water to accumulate. Two methods to increase the water holding capacity of a base 16 include increasing the depth of the base 16, and increasing the void space in the base 16. The minimum thickness of the base 16 can be calculated based on the required water storage capacity, the area of the traffic bearing surface 10, and the porosity of the aggregate 20. Alternative techniques can be used, such as providing a lift 26 which extends beyond the sides of a permeable pavement 22, to increase the water holding capacity of the base 16.

In order to facilitate the permeability of a permeable pavement 22, the lift 26 positioned underneath the permeable pavement 22 should have a permeation rate at least as high as the permeation rate of the permeable pavement 22. This allows water to drain out of the permeable pavement 22 into the lift 26 as fast as water will pass through the permeable pavement 22. If the permeation rate of the lift 26 was slower than the permeable pavement 22, water would collect at the interface and slow the rate at which water flowed through the permeable pavement 22.

The top layer of a traffic bearing structure 10 is referred to as the wear surface 18. There can be objects on top of the wear surface 18, such as paint 42 or parking curbs 44, and the material under the paint is still the wear surface 18. Permeable pavement 22 is one type of wear surface 18, because permeable pavement 22 is frequently used as the top layer of a traffic bearing structure 10. One type of permeable pavement 22 is a block paver 30. Block pavers 30 are generally a type of pavement which includes a plurality of solid blocks placed near each other to make a wear surface 18. The individual block pavers 30 of a block paver 30 surface can include rocks, bricks, ceramics, interlocking tiles, or a wide variety of other materials. The individual block pavers 30 can be permeable and allow water to pass through the block paver 30 itself, but it is also possible to have non-permeable individual block pavers 30 that still provide a permeable pavement 22. This is possible because the gaps between adjacent block pavers 30 can be filled with a permeable gap filling material 32. This gap filling material 32 can be sand, small aggregate 20, or other similar materials which serve to fill the space between individual adjacent block pavers 30. Runoff that hits a nonpermeable block paver 30 drains to the gap between adjacent block pavers 30, percolates down through this gap-filling material 32, and thereby enters the base 16. The gap filling material 32 is considered part of the wear surface 18, and not part of the base 16.

Figure 3:
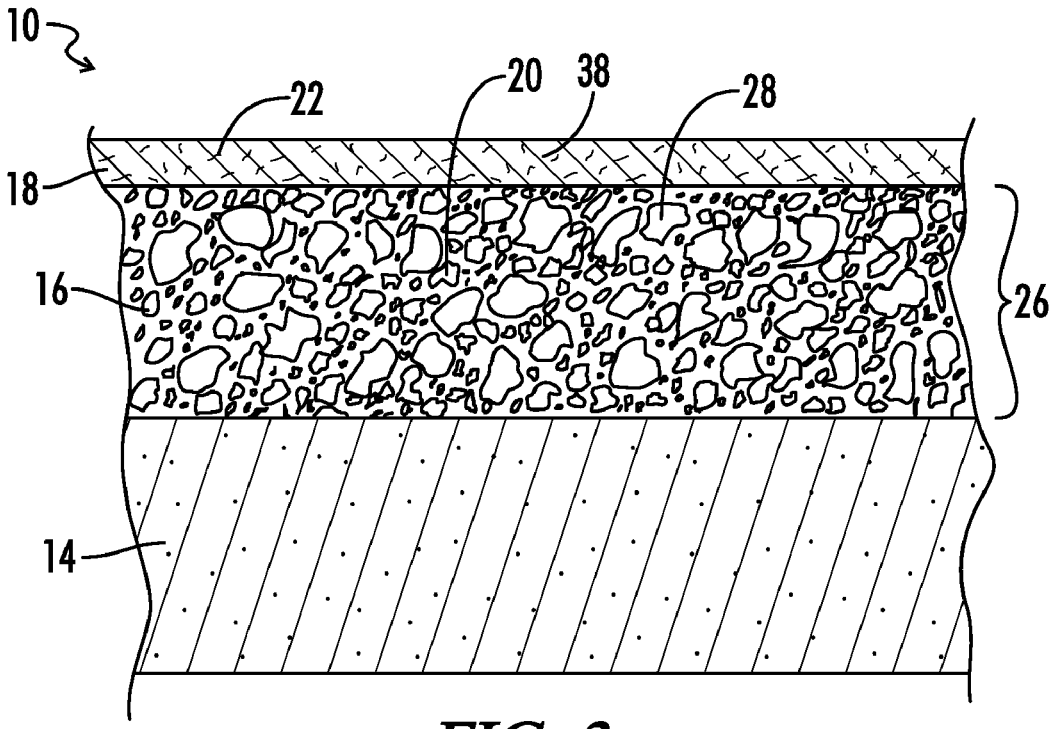
FIG. 3 is a cross sectional side view of a traffic bearing structure embodiment with relatively uniform compaction of the aggregate in the base.
Figure 4:
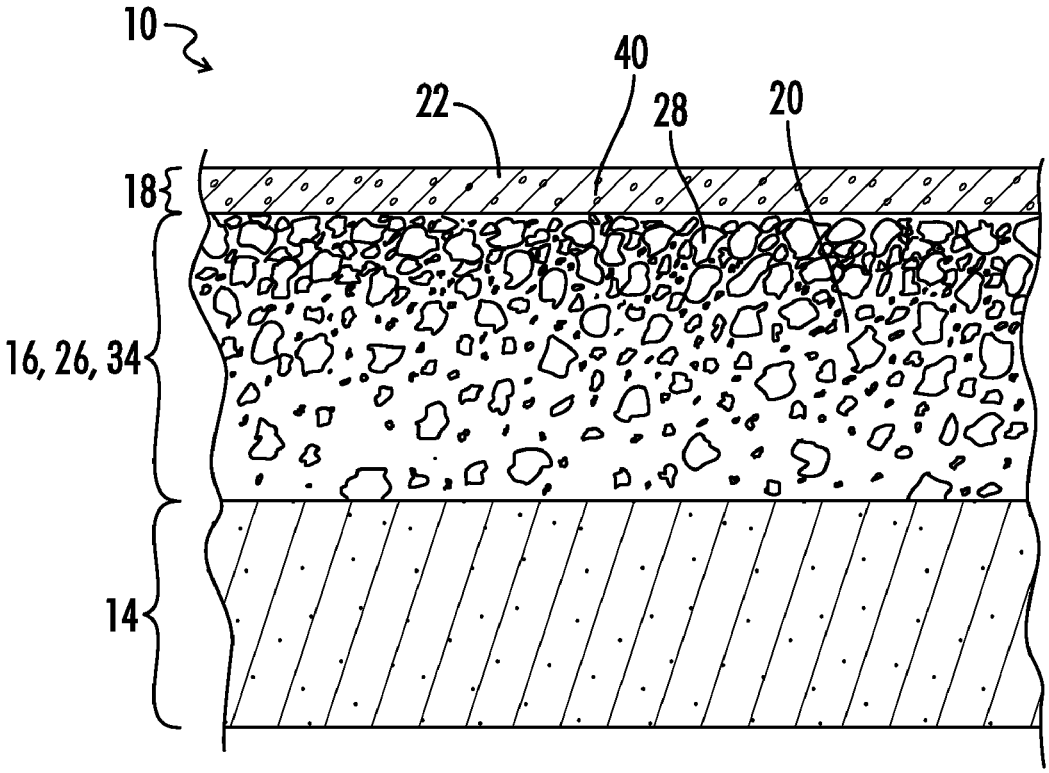
FIG. 4 is a cross sectional side view of a traffic bearing structure embodiment with a compaction gradient in the base, where the wear surface is porous concrete.

Another type of permeable pavement 22 is porous asphalt 38, as seen in FIGS. 1 and 3. This is a type of asphalt which has interconnected voids such that water can percolate through the porous asphalt 38. Porous asphalt 38 can be made by using different size stones and/or different types of binding material from those used in non-permeable asphalts. For example, screening out the fines from standard bituminous asphalt can increase the void space and make the asphalt permeable. Yet another type of permeable pavement 22 is a porous concrete 40, as seen in FIG. 4, with continuing reference to FIGS. 1-3. As with the porous asphalt 38, the porous concrete 40 has interconnected voids for allowing water to pass, and the porous concrete 40 can be formed by using different size aggregates 20 and/or different amounts and/or types of binder between the aggregates 20. Turf pavers are yet another type of permeable pavement 22. Turf pavers include a support system for bearing weight, where the support system provides gaps where grass or other plants can grow. Porous asphalt 38, block pavers 30, and turf pavers can be more flexible than porous concrete 40, and so there can be somewhat different requirements for the base 16 under each surface. The requirements of the base 16 depend somewhat on the wear surface material used.

A traffic bearing structure 10 has many uses. This includes parking lots, roads, and other surfaces which are designed for supporting vehicles and traffic. The strength of the traffic bearing surface 10 depends largely on the support underneath the wear surface 18. Greater support from the base 16 is required for wear surfaces 18 which will be exposed to higher traffic loading. Higher traffic loading can be the result of heavier vehicles and/or more frequent vehicle traffic or movement. Permeable wear surfaces 18 used for non-vehicular traffic typically require less stability and less strength. It is also generally noted that most roads have a higher traffic loading requirement than parking lots. However, the exact traffic loading requirement for a particular project can be specified, and can vary from place to place and from one use to another.

Subgrade

Subgrade 14 is generally the bottom layers or the lowest layer of a traffic bearing surface 10. The subgrade 14 can be the natural soil which has been excavated, cleared or formed in some way to the desired shape for the traffic bearing structure 10. It is possible the soil or ground can be used in its natural existing shape without any grading depending on the needs for the traffic bearing structure 10 and the shape and composition of the land 12 at that particular location. It is also possible to add some material to form a subgrade 14. This can include the addition of aggregate 20, clay, sand, or some other material.

In many cases, it is desirable for the subgrade 14 to be permeable to water at least at some rate when designing a traffic bearing structure 10 using permeable pavement 22. However, it is also possible to make a permeable pavement 22 with a nonpermeable subgrade 14. Water can be stored in the base 16 and leave the base 16 through water drain lines 24, weirs, or even through the use of capillary action and the evaporation of water from the surface of the permeable pavement 22. The subgrade 14 can be compacted or it can be left as graded. This includes when the subgrade 14 is added aggregate 20, clay or other material, or when the subgrade 14 is the natural soil which has been graded to the desired shape. Compacting the subgrade 14 can reduce the permeability while increasing the stability and strength. A permeable subgrade 14 may be desirable for permeable pavements, so little or no compaction of the subgrade may be desired.

The subgrade 14 generally does not provide the strength and stability for the wear surface 18 as much as the base 16. In some instances, the subgrade 14 is considered non-structural, in that it is not a primary component for bearing the weight placed on the wear surface 18. Providing a stable base 16 can allow for a subgrade 14 which has not been compacted.

Base

The base 16 is the material positioned between the wear surface 28 on the top and the subgrade 14 on the bottom of the traffic bearing structure 10. In some embodiments, the base 16 is comprised of at least one sized aggregate 20. When used with a permeable pavement 22, the base 16 is often used to hold water until accumulated water can be gradually discharged. The base 16 frequently has a structural function and provides strength for the wear surface 28, but it is possible to have components of the base 16 which are not structural and are primarily used for permeability or for other purposes. The base 16 under a permeable pavement 22 serves the dual functions of providing stability and permeability. The base 16 under a non-permeable pavement may not require the same level of permeability to function properly.

The base 16 generally provides much of the strength and stability of the wear surface 28. A certain strength and stability is needed to support vehicular traffic, and greater stability and strength can support higher traffic loading. The minimum stability and permeability is often specified for a particular traffic bearing structure. Higher traffic loading means loadings of heavier vehicles and/or more vehicles passing a point of the traffic bearing structure 10. As a general rule, roads tend to require more stability than parking lots, although there can be exceptions. The base 16 under a permeable pavement 22 should provide both the necessary stability and the permeability necessary to support the traffic and to allow water to drain from the permeable pavement 22 and to be temporarily stored within the base 16.

The base 16 is generally produced by adding a loose material such as an aggregate 20, and then compacting that aggregate 20 into a lift 26. The lift 26 can be compacted with vibratory devices, and this can produce a relatively consistent compaction throughout the lift 26. The vibratory devices vibrate as they compact, and this can cause the lift 26 to become more compacted from the bottom up instead of from the surface down. This can also result in a lift 26 which has a relatively consistent compaction percentage throughout the depth of the lift 26.

In some embodiments, a lift 26 is compacted without the use of vibratory devices. This can include the use of rollers or other compaction devices, as is known in the art. This can produce a lift 26 which has a compaction gradient 34. Generally, a compaction gradient 34 is characterized by material near the top of the lift 26 being more compacted than material near the bottom of the lift 26, as seen in FIGS. 1 and 4. More compacted aggregate 20 has less void space between the particles 28 than less compacted aggregate 20. A compaction gradient 34 can involve a gradual lessening of the degree of compaction as one moves from the top to the bottom of the lift 26. This allows one to inspect a traffic bearing structure 10 and determine the number of lifts 26 used in a base 16. The different degrees of compaction in a compaction gradient 34 allow one to identify the different lifts 26 in a base 16 similar to the growth rings in a tree, because there is a physical difference in a base 16 depending on the number of lifts 26.

If different types of aggregate 20 are used in a base 16, they are often compacted separately, as seen in FIG. 1. In some embodiments, a geo-fabric or other material can be placed between different sized aggregates 20 to control particle migration. Therefore, a coarser aggregate 20 may be used underneath a finer aggregate 20, and there would typically be at least two lifts 26 where the coarse aggregate 20 was compacted before the finer aggregate 20 was added, and then the finer aggregate 20 would be compacted afterwards. In some embodiments, a geo-fabric is not used, including some embodiments where only one sized aggregate 20 is used.

The act of compacting a lift 26 takes time and increases the overall installation cost of a traffic bearing structure 10. The time and effort of preparing the aggregate 20 before compaction such that you have a relatively uniform surface and depth, and then the actual act of compacting the lift 26 each require time and effort. Increased construction time generally causes increased installation costs because this involves the payment of personnel and the use of equipment. A technique which reduces the number of lifts 26 and still produces a viable and functional traffic bearing structure 10 can reduce the overall cost of installing the traffic bearing structure 10. The use of a single lift 26 in the base 16 can also provide more uniform water permeation, because the water does not pass through multiple compaction gradients in the base 16.

In many cases, the degree of compaction for a base 16 and for each lift 26 can be specified. For example, in one embodiment using a permeable pavement 22, the base 16 is comprised of one single lift 26. This one single lift 26 can be compacted to between 90 and 95 percent. This compaction standard of 90 to 95 percent can determined by the standard Proctor compaction test, ASTM test method D 698 (07), but other test methods are available, such as the AASHTO T 99 (09) test. Particular versions of a test can also be provided, so consistency can be maintained regardless of changes in a testing version, and the (07) and (09) listed after the test methods above represent the version of the test. The version can be based on the year the test was revised, so ASTM D 698 (07) indicates the ASTM D 698 test as revised in 2007. ASTM, which was originally known as the American Society for Testing and Materials, provides many standard test methods for various materials so different entities have a common measure for comparison purposes. Alternatively, a lift 26 can be compacted to the density necessary to achieve a required minimum stability with a required permeability.

In general, the greater the degree of compaction, the less the degree of void space remaining within the lift 26. As a general rule of thumb, the less void space available in a lift 26, the lower the permeability rate of the lift 26 and the higher the strength and stability of the lift 26. Alternatively, the greater the void space within a lift 26, the higher the permeability of the lift 26 and the lower the stability and strength of the lift 26. Therefore, the use of certain sized aggregate 20 can provide a desired range of strength, stability and permeability, but this is at least somewhat dependent on the compaction standard used. In one embodiment of the current invention, if the aggregate 20 is compacted less than 80%, the void space may be too large and the strength and stability of the lift 26 can be less than specified. If the compaction is greater than 95%, the void space can be reduced to the point where the permeability rate is no longer acceptable, and the water holding capacity of the lift 26 is reduced to a point beyond that desired. Therefore, the degree of compaction required can depend on the required stability and permeability, so specifying stability and permeability can effectively dictate the degree of compaction for a particular aggregate 20.

Aggregate

"Aggregate" 20 is generally defined as a collection of hard particles 28. In many instances, the particles 28 are rock or stone, but it is also possible to use other materials such as shells, broken bricks, broken ceramic, cast ceramic, metal, or other materials. As a general rule, there are three broad families of aggregate 20 used in the construction of traffic bearing structures 10. The first family is referred to as well-graded. A well-graded aggregate 20 includes particles 28 of varying sizes, and the ratio of the particles 28 of the varying sizes are somewhat proportional. With well-graded aggregate 20, the larger the top particle size, the stronger and more stable the aggregate 20 tends to be. The various particle sizes can be essentially uniformly mixed in a well graded aggregate 20, so a sample taken from one location has essentially the same particle size distribution as a sample taken from another location.

A second type of aggregate 20 is referred to as uniform gradation aggregate 20. With a uniform gradation aggregate 20, essentially all of the particles 28 are approximately the same size. The particle size is relatively consistent with uniform gradation. In some embodiments, the void space does not change significantly based on particle size. For example, for perfectly round particles 28, the overall void space is approximately the same for large particles 28 or small particles 28. For example, a container of basketballs will have approximately the same void space as the same container of ping pong balls, where the void space refers to the space between the balls as opposed to the space within them. The higher the void space, the lower the stability tends to be, and vice versa. As a general rule, it is unusual to find a uniform gradation aggregate 20 with a high stability.

A third type of aggregate 20 is referred to as gap graded. A gap graded aggregate 20 is a collection of particles 28 of various sizes, but there is a gap in the particle size distribution. This means that a particular size of particle 28 in the middle of a particle distribution tends to be missing. So for example, if an aggregate 20 had 25% size 1 particles, 25% size 2 particles, 0% size 3 particles, 25% size four particles, and 25% size five particles, this would be referred to as gap graded, where the particles 28 increase in size from one to five.

Figure 5:
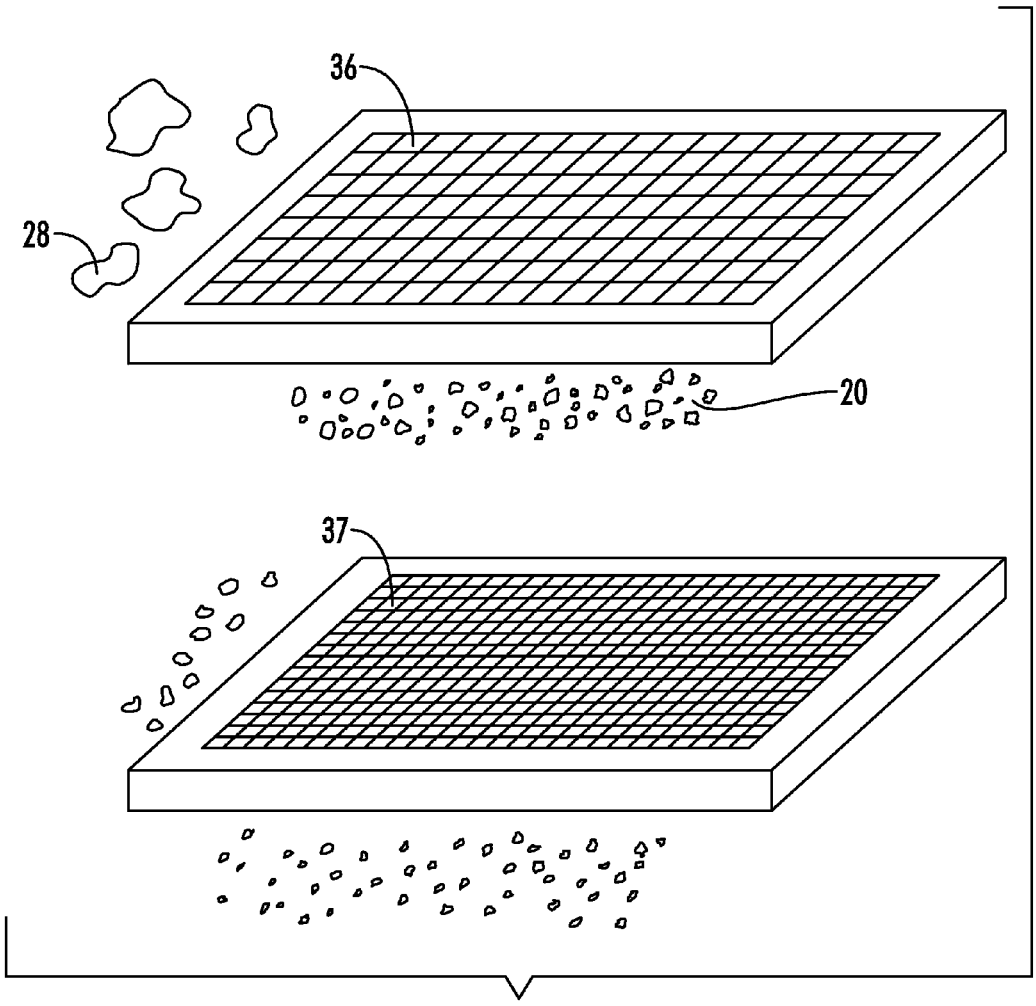
FIG. 5 is a schematic of screens used to size particles in an aggregate.

Particles 28 are generally sized based on the mass percentage of an aggregate 20 that will pass through different sized screens, as seen in FIG. 5, with continuing reference to FIGS. 1-4. The entire mass of the aggregate 20 will be dumped onto the first screen 36, which is the largest size screen, and the particles 28 that do not pass through are collected, and can be weighed. The particles 28 that do pass through the first screen 36 fall to the second screen 37. The particles 28 on the second screen 37 are then sorted based on the size of the screen, where the second screen 37 will have smaller gaps than the first screen 36. Some particles 28 which were able to pass through the first screen 36 are too big to pass through the second screen 37. These particles 28 are then separated and collected, and can then be weighed. The particles 28 that pass through the second screen 37 can go through another screen, and this can be repeated, for as many screens as desired.

One particular aggregate 20 has been found which is very desirable for use in the base 16 under permeable pavements 22. This aggregate 20 has some rather loose specifications, as will be described later, and fits within the well graded aggregate family. This aggregate 20 serves the dual functions of providing stability and permeability in a base 16, and is referred to as "dual purpose aggregate" 20 in this description. The dual purpose aggregate 20 has some particles too large to pass through a 12 millimeter screen, and some particles small enough to pass through a 5 millimeter screen. In another embodiment, the dual purpose aggregate 20 has some particles too large to pass through a 12 millimeter screen, and some particles small enough to pass through a 1.2 millimeter screen.

In another embodiment, essentially all particles in the dual purpose aggregate 20 pass through a 37.5 millimeter screen, 90 to 100% of the particles 28 pass through a 25 millimeter screen, 60 to 90% of the particles 28 pass through a 12.5 millimeter screen, 30 to 70% of the particles 28 pass through a 4.75 millimeter screen, 7 to 40% of the particles 28 pass through a 1.18 millimeter screen, 0 to 25% of the particles 28 pass through a 0.425 millimeter screen, and 0 to 4% of the particles 28 pass through a 0.075 millimeter screen. Converting this to English units, approximately 100% of the particles 28 pass through a 1.5 inch screen, 90 to 100% of the particles 28 pass through a one-inch screen, 60 to 90% of the particles 28 pass through a ½ inch screen, 30 to 70% of the particles 28 pass through a number 4 mesh screen, 7 to 40% of the particles 28 pass through a number 16 mesh screen, 0 to 25% of the particles 28 pass through a number 40 mesh screen, and 0 to 4% of the particles 28 pass through a number 200 mesh screen.

Other general specifications which may apply to the dual purpose aggregate 20 are listed in the table below. These specifications may vary somewhat for different quarries or sources of aggregate.

| Property | ASTM test method (version) | Measurement |
|---|---|---|
| Sulfate Soundness | C 88 (05) | 15% max. loss (Na), 20% max. loss (Mg) |
| Clay Lumps | C 142 (04) | 2.0% Maximum |
| LA Degradation | C 131 (06) | 60% loss maximum |
| Crushed faces | D 5821 (06) | 75% minimum with 2 crushed faces |

With a well-graded aggregate 20, the large particles 28 tend to provide permeability and relatively high void space. Smaller particles 28 tend to fill in these voids and provide increased stability. As a general rule, increased stability comes with decreased permeability and water storage. Careful selection of the particle size distribution can result in an aggregate 20 which is capable of providing the stability necessary for a permeable pavement 22 for use as a traffic bearing structure 10 and still provide the permeability necessary for water to permeate into the base 16 at an acceptable rate.

The term "stability," as used in this description, is defined by particular tests which measure the stability. One such test is the California Bearing Ratio (CBR) test, and another test is the R value test. The ASTM test method D 1883 (07) describes the CBR test, and ASTM test method D 2844 (07) describes the R value test. The R value test is also described in the CalTrans Test 301(00), the AASHTO T 190 (09), and other standard test methods are also available. The CBR test is also described in AASHTO T 193 (07). The number provided in brackets "( )" after a referenced test method in this description refers to the year of the latest revision, so ASTM D 1883 (07) means the ASTM D 1883 test as revised in 2007.

Selecting the proper particle size distribution can provide a dual purpose aggregate 20 with a CBR stability of at least 40, as measured by the ASTM test D 1883 (07), and a permeation rate of 30,000 millimeters per day, as measured by ASTM test D 2434 (06). Alternatively, a dual purpose aggregate 20 can be provided with a CBR stability of at least 25 and a permeability of at least 8,500 millimeters per day, using the same tests mentioned above. The stability and permeation rate are determined after a bed of the dual purpose aggregate 20 has been compacted into a lift 26. The dual purpose aggregate 20 can therefore have an essentially known void space after the proper compaction, so a specification for the void space after compaction can be established. The dual purpose aggregate 20 can have at least 25% voids after compaction, as measured by the ASTM 698 (07) test. Alternatively, the dual purpose aggregate 20 can have a void specification of 30% after compaction, using the same test method. This lift 26 can be a single lift 26 placed directly on top of the subgrade 14, and the wear surface 18 can be placed directly on top of the single lift 26, so the single lift 26 directly contacts both the subgrade 14 and the wear surface 18.

It has been found that the stability provided by the dual purpose aggregate 20 is sufficient to support a stake pounded into the dual purpose aggregate 20 after compaction. Stakes can be used as edge restraints during construction projects. It has also been found that after compaction, the dual purpose aggregate 20 is stable enough to support vehicular traffic without creating wheel ruts, and this can be beneficial for placing the permeable pavement 22. The increased stability may decrease the required thickness of the permeable pavement 22 in the wear surface 18, which can save on costs for the traffic bearing structure 10.

By selecting the proper particle size distribution for the dual purpose aggregate 20, it has been found that an increased stability can be combined with an acceptable permeability when the aggregate 20 is compacted in a single lift 26. The exact specifications for the particle size distribution can vary for different products. For example, in a quarry which collects and crushes limestone for dual purpose aggregate 20, the particle size distribution may be different than a quarry which collects and crushes granite for use in a dual purpose aggregate 20. Many factors can impact the properties of an aggregate 20. These include the particle size and the particle shape, where round particles 28 will act differently than cubical particles 28, which will act different than any other shapes. Essentially cubically shaped particles 28 can be preferred to essentially round or needle shaped particles 28 in the dual purpose aggregate 20. Many other factors can influence the particle size distribution for the dual purpose aggregate 20 which provides the desired stability and permeability when compacted to the specified level. The factors include the material of the particle 28, the strength of the particle 28, the coefficient of friction of the particle 28, the specific gravity of the particle 28, the surface texture of the particle 28, and other properties. Different starting materials can result in different particle size distribution specifications to meet the permeability and stability specifications for the dual purpose aggregate 20.

It is generally found that a permeation rate of at least 30,000 millimeters per day as measured by the ASTM D 2434 (06) test can be combined with the CBR stability of at least 40 as measured by the ASTM D 1883 (07) test, and this can be done by selecting the particle size distribution from a particular quarry. In an alternative embodiment, a permeation rate specification of at least 8,500 millimeters per day combined with a CBR stability specification of at least 25 can be obtained. The stability and permeation rate are established when the dual purpose aggregate 20 is compacted to a specified level, which is generally between a standard Proctor value of about 90% and 95% compaction as measured by the ASTM D 698 (07) test. However, in other embodiments, the compaction level is the amount of compaction necessary to obtain both the permeability and stability requirements. Too much compaction can decrease the void spaces in the dual purpose aggregate 20 and may lower the permeability to an unacceptable rate. Also, too little compaction can leave excessive void spaces and lower the stability to an unacceptable level.

The specification can require compaction be performed by rollers, as opposed to being performed by vibratory compaction equipment, but in some embodiments vibratory compaction may be acceptable. The type, weight, and number of rollers should be sufficient to obtain the required density, and the required permeability and stability. Caution should be taken when using vibration to avoid aggregate fracture. The degree of compaction can be determined using conventional methods including, but not limited, nuclear density gauge and non-nuclear devices.

Certain compaction techniques can provides a compaction gradient. A compaction gradient can be desirable because the higher portions of the lift 26 are more compacted, and therefore have less void space. The more compacted higher portions of the lift 26 are closer to the wear surface 18, and provide increased stability directly underneath the wear surface 18. The lower portions of the lift 26 are less compacted, have more void space, and provide for greater water holding capacity and permeability. The stability of the lower portions of the base 16 is not as important as the stability of the upper portions of the base 16, because of the proximity to the wear surface 18. As with the particle size distribution, the exact compaction specified can vary for different raw materials, and the compaction specification is determined in conjunction with the particle size specification for each different raw material.

Generally, each individual quarry will have at least somewhat different raw materials, and testing may be required for each quarry to determine the particle size distribution specification and the compaction specification necessary for the dual purpose aggregate 20 to have the desired stability and permeation rate. Other factors that can be considered include the hardness and/or the durability of the aggregate particle 28. By preparing an aggregate 20 material with a pre-set particle size distribution and testing this aggregate 20 material, the particle size distribution that is necessary to give the required specifications for any particular quarry can be experimentally determined.

In general, increasing the size of the largest particles 28 will increase the strength, hardness and durability of the dual purpose aggregate 20. Increasing the percentage of smaller particles 28 will increase the stability of the dual purpose aggregate 20, decreasing the percentage of the smaller particles 28 will increase the permeability of the dual purpose aggregate 20, and vice versa. Increasing the percentage of larger particles 28 will tend to increase permeability and decrease stability, and vice versa. Increases of the percentage of larger intermediate sized particles 28 will increase permeability and decrease stability, but to a lesser extent than increases in the largest sized particles 28. Increases in the percentage of the smaller intermediate particles 28 tends to increase stability and decrease permeability, but to a lesser extent than increases in the percentage of the smallest particles 28.

Overall, the specification for the particle size distribution should be set somewhat proportionally for the various sizes, because a relatively proportional particles size distribution tends to provide a better balance of dual purpose aggregate properties. The coefficient of uniformity ($C_u$) can be set to be greater than or equal to 5. $C_u = D_{60}/D_{10}$, where $D_{60}$ and $D_{10}$ are the particle grain diameters corresponding to 60 and 10 percent passing respectively. Product grading can be plotted on a 0.45 power graph with the maximum density line (MDL) drawn from the zero ordinate through the maximum aggregate size. Grading can be set to plot as an "S-shaped" curve by deviating above and below the MDL at large and smaller aggregate sizes, respectively. Grading can also be set so the grading lot only crosses the MDL once.

By performing specific tests on material taken from a quarry, a set particle size distribution can be found which provides the desired specifications for stability and permeability of the dual purpose aggregate 20, where both properties are determined at a specified compaction ratio. Specifications can also be set for the hardness and durability of the various aggregate particles 28. Increased hardness can increase both the permeation rate and the stability of an aggregate 20 by minimizing the number of broken or crushed particles 28.

As a nonlimiting example, it has been found that one specific quarry, the quarry located in McCook, Ill., which was owned and operated by Vulcan Materials Company as of January, 2010, has produced an aggregate 20 with the following particle size distribution, or gradation.

| Screen size in English units | Screen size in millimeters | Measured percentage |
|---|---|---|
| 1½" | 37.5 mm | 100 |
| 1" | 25 mm | 98.3 |
| ¾" | 19 mm | 90.2 |
| ⅝" | 16 mm | 81.8 |
| ½" | 12.5 mm | 70.5 |
| ⅜" | 9.5 mm | 59.2 |
| ¼" | 6.3 mm | 45.7 |
| #4 | 4.75 mm | 37.4 |
| #8 | 2.36 mm | 23.7 |
| #16 | 1.18 mm | 14.6 |
| #40 | 0.425 mm | 7.9 |
| #200 | 75 μm | 3.44 |
| PAN | 0 μm | 0 |

" represents inches. mm represents millimeters. μm represents micrometers.

Testing has been performed on aggregates taken from this quarry in McCook, Ill. Typical results include a CBR stability of 25 with a permeability of 1000 feet per day at a compacted density of approximately 90%, and a CBR stability of 40 with a permeability of 800 feet per day at a compacted density of approximately 90%, as measured by ASTM D 1883 (07), ASTM D 2434 (06), and ASTM D 698 (07). The type of stone primarily available at this quarry is dolomite.

The use of the dual purpose aggregate 20 as described herein allows the production of a traffic bearing structure 10 using permeable pavement 22 for the wear surface 18, where the traffic bearing structure 10 has a base 16 with one single lift 26. This also allows the use of permeable pavement 22 with traffic bearing structures 10 having a load requirement of in excess of that typically experienced on driveways and parking lots. In an alternate embodiment, the dual purpose aggregate 20 as described herein can be a top lift 46 positioned over at least one lower lift 48, where the top lift 46 and lower lift 48 are both in the base 16. The lower lift 48 can include a different, larger average sized aggregate 20 than the dual purpose aggregate 20. The larger sized aggregate 20 of the lower lift 48 can provide larger void spaces for holding water and for increased permeability, and the dual purpose aggregate 20 in the top lift 46 provides the stability for relatively high traffic loading requirements with an acceptable permeability. In yet another embodiment, the dual purpose aggregate 20 as described herein can be used repeatedly in multiple lifts 26 within one base 16.

Method of Installation

The traffic bearing structure 10 using a permeable pavement 22 can be installed as described below. The first step is the preparation of a subgrade 14. This can be done by leveling an area with grading, smoothing this area, and preparing this area to have the general shape of the desired traffic bearing structure 10. Preferably, the subgrade 14 should have a maximum gradient of 5%, although higher percentages are allowable with the understanding that increased water runoff may result. Methods for draining water can then be laid out on top of the subgrade 14 or embedded at least partially within the subgrade 14. This can include drain lines 24, pipes or tubes which can be perforated to allow the inflow of water. There can be fabric covers over these drain lines 24 to reduce the inflow of debris and dirt into these drain lines 24. The preparation of the subgrade 14 can also include the preparation of weirs or other devices which will allow water to percolate out of the base 16 which will be positioned on top of the subgrade 14. The subgrade 14 can be compacted to a specified compaction ratio, or left uncompacted.

The next step is to pour loose dual purpose aggregate 20 on top of the subgrade 14. The loose dual purpose aggregate 20 should be applied and used with techniques that tend to avoid the differentiation by size of the various particles 28 within the dual purpose aggregate 20, as is understood by those knowledgeable in the art. The next step is to grade the loose dual purpose aggregate 20 to a relatively level and smooth surface. This level and smooth surface may impact the surface structure of the permeable pavement 22, so care should be taken to provide an acceptable surface.

The next step is to compact the dual purpose aggregate 20 in a single lift 26. This can involve repeated passes with a compactor, but it does not involve the addition of more aggregate 20. The compaction should be performed until the dual purpose aggregate 20 reaches the proper compaction ratio, which can be determined using ASTM test D 698 (07). After the dual purpose aggregate 20 is compacted, the permeable pavement 22 is added on top of the dual purpose aggregate 20. Installation of the permeable pavement 22 can involve the use of motorized equipment on top of the dual purpose aggregate 20, and the stability of the compacted dual purpose aggregate 20 can facilitate this traffic.

Different permeable pavements 22 can be placed on top of the dual purposes aggregate 20. The step of installing the permeable pavement 22 can include placing block pavers 30 in position. The block pavers 30 can be interlocking, but they may not be interlocking. Installation of the permeable pavement 22 can also include filling the gaps between block pavers 30 with a gap tilling material 32. In an alternate embodiment, porous asphalt 38 can be applied on top of the base 16 as the permeable pavement 22, where the porous asphalt is used in place of the block pavers 32. The porous asphalt 38 is applied in a similar matter to standard, non-permeable asphalt. In yet another embodiment, a porous concrete 40 can be applied as the permeable pavement 22 and again, the application of the porous concrete 40 is similar to the application of standard, non-permeable concrete. Another possible embodiment includes installing turf pavers, using techniques provided by the manufacturer or techniques known to those skilled in the art. It is possible to apply one type of permeable pavement 22 on top of another, as desired.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

What is claimed is:

1. A method for installing a traffic bearing structure comprising:

(a) preparing a subgrade;

(b) installing a loose aggregate over the subgrade, where 90 to 100% of the aggregate passes through a 25 millimeter screen, 60 to 90% of the aggregate passes through a 12.5 millimeter screen, 30 to 70% of the aggregate passes through a 4.75 millimeter screen, and 7 to 40% of the aggregate passes through a 1.18 millimeter screen;

(c) compacting the aggregate into a single lift; and (d) covering the aggregate with a permeable pavement such that the permeable pavement directly contacts the aggregate.

2. The method of claim 1 where the permeable pavement is selected from the group consisting of block pavers, porous asphalt, porous concrete, and turf pavers.

3. The method of claim 2 where the permeable pavement is porous asphalt.

4. The method of claim 2 where the permeable pavement is block pavers.

5. The method of claim 1 where the aggregate in the single lift has a permeability of at least 30,000 millimeters per day as measured by the ASTM D 2434 test method and a California Bearing Ratio (CBR) stability of at least 40 as measured by ASTM D 1883 (07).

6. The method of claim 1 where the aggregate in the single lift has a permeability of at least 8,500 millimeters per day as measured by the ASTM D 2434 (06) test method and a California Bearing Ratio (CBR) stability of at least 25 as measured by the ASTM D 1883 (07) test method.

7. The method of claim 1 where the aggregate has at least 25% void space after step (c).

8. The method of claim 1 where the aggregate has at least 30% void space after step (c).

9. A traffic bearing structure comprising:

a subgrade;

a base including a single lift positioned on top of the subgrade, where the lift includes an aggregate, where 90 to 100% of the aggregate passes through a 25 millimeter screen, 60 to 90% of the aggregate passes through a 12.5 millimeter screen, 30 to 70% of the aggregate passes through a 4.75 millimeter screen, and 7 to 40% of the aggregate passes through a 1.18 millimeter screen; and a wear surface positioned on top of the lift, where the wear surface includes a permeable pavement selected from the group consisting of block pavers, porous asphalt, and porous concrete.

10. The traffic bearing structure of claim 9 where the lift has a permeability of at least 8,500 millimeters per day as measured by the ASTM D 2434 (06) test and a California Bearing Ratio stability of at least 25 as measured by the ASTM D 1883 (07) test.

11. The traffic bearing structure of claim 9 where the permeable pavement is block pavers.

12. The traffic bearing structure of claim 9 where the permeable pavement is porous asphalt.

13. The traffic bearing structure of claim 9 where the permeable pavement is porous concrete.

14. The traffic bearing structure of claim 9 further comprising at least one drain line positioned within the base.

15. The traffic bearing structure of claim 9 where the aggregate is compacted to between 90 and 95% as measured by the ASTM D 698 (07) test.

16. The traffic bearing structure of claim 9 where the lift has one single compaction gradient.

* * * * *